US012577844B2

(12) United States Patent
Berry

(10) Patent No.: US 12,577,844 B2
(45) Date of Patent: Mar. 17, 2026

(54) ELECTRICALLY ACTUATED ACCESS MODULE SYSTEMS AND METHODS

(71) Applicant: OneSubsea IP UK Limited, London (GB)

(72) Inventor: Cameron Berry, Banchory (GB)

(73) Assignee: OneSubsea IP UK Limited, London (GB)

( * ) Notice: Subject to any disclaimer, the term of this patent is extended or adjusted under 35 U.S.C. 154(b) by 0 days.

(21) Appl. No.: 18/793,466

(22) Filed: Aug. 2, 2024

(65) Prior Publication Data

US 2025/0043647 A1 Feb. 6, 2025

Related U.S. Application Data

(60) Provisional application No. 63/517,266, filed on Aug. 2, 2023.

(51) Int. Cl.
*E21B 33/035* (2006.01)
*E21B 34/04* (2006.01)

(52) U.S. Cl.
CPC ..... *E21B 33/0355* (2013.01); *E21B 34/04* (2013.01)

(58) Field of Classification Search
CPC ..... E21B 33/0355; E21B 34/04; E21B 33/038
See application file for complete search history.

(56) References Cited

U.S. PATENT DOCUMENTS

2011/0079395 A1 4/2011 Vaynshteyn
2018/0195362 A1* 7/2018 Slater ..... E21B 33/064
2018/0274319 A1* 9/2018 Lycke ..... E21B 33/0355

FOREIGN PATENT DOCUMENTS

WO 2013058972 A1 4/2013
WO WO-2018019468 A1 * 2/2018 ..... E21B 33/0355
WO WO-2023102219 A1 * 6/2023 ..... F16K 31/047

OTHER PUBLICATIONS

Search Report and Written Opinion of International Application No. PCT/US2024/040774 dated Nov. 22, 2024, 11 pages.

* cited by examiner

*Primary Examiner* — James G Sayre
(74) *Attorney, Agent, or Firm* — Jeffrey D. Frantz

(57) ABSTRACT

An intervention system is provided. The intervention system includes an intervention package. The intervention package is used to couple to a subsea tree and to perform hydraulic or mechanical operations on subsea wells or flowlines. The intervention package includes a first interface that is configured to couple to the subsea tree. The intervention package further includes a fluid flow path through the intervention package to the first interface. The intervention package further includes an electric actuator coupled to a valve along the fluid flow path. The intervention package further includes a controller coupled to the electric actuator. The controller is used to control the electric actuator to control the valve.

19 Claims, 9 Drawing Sheets

ELECTRICALLY ACTUATED ACCESS MODULE SYSTEMS AND METHODS

CROSS-REFERENCE TO RELATED APPLICATIONS

This application claims benefit of U.S. Provisional Patent Application No. 63/517,266, filed on Aug. 2, 2023, which is hereby incorporated by reference in its entirety for all purposes.

BACKGROUND

The present disclosure generally relates to systems and methods for subsea intervention packages. More specifically, the present disclosure is directed to electrically actuated intervention systems.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it may be understood that these statements are to be read in this light, and not as admissions of prior art.

Intervention packages provide access to perform hydraulic or mechanical operations on subsea wells or flowlines. Intervention packages may interface with subsea trees (e.g., Christmas trees) to address loss of production or other intervention scenarios. Traditionally, subsea intervention systems use hydraulic actuators for operating subsea valves and other equipment on subsea intervention systems. Operation of hydraulic actuators require a hydraulic fluid source for operation of moving parts, such as a hydraulic piston that moves within a cylinder. Hydraulic actuators may also be impacted by environmental conditions (e.g., temperatures, pressures, etc.) in subsea environments. As such, there is a need to incorporate electrical actuators into subsea intervention systems that may improve reliability and control of subsea valves.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In certain embodiments, a system is provided that includes an intervention system used to couple to a subsea tree, wherein the intervention package includes a first interface configured to couple to the subsea tree, a fluid flow path through the intervention package to the first interface, a first electric actuator coupled to a first valve along the fluid flow path, and a controller coupled to the first electric actuator, wherein the controller is used to control the first electric actuator to control the first valve.

In certain embodiments, a method includes obtaining sensor feedback from at least one sensor coupled to a fluid flow path through an intervention package having a first interface coupled to a subsea tree and controlling a first electric actuator coupled to a first valve along the fluid flow path at least partially based on the sensor feedback.

In certain embodiments, a system includes an intervention system to supply a fluid from a riser coupled to a vessel to a subsea tree, wherein the intervention system includes an intervention package with a first electric actuator coupled to a first valve and a second electric actuator coupled to a second valve. The system also includes a controller having a processor, a memory, and instructions stored on the memory and executable by the processor to receive one or more signals from one or more sensors, and control, via the first electric actuator and the second electric actuator, a fluid flow between the intervention package and the subsea tree.

Various refinements of the features noted above may exist in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
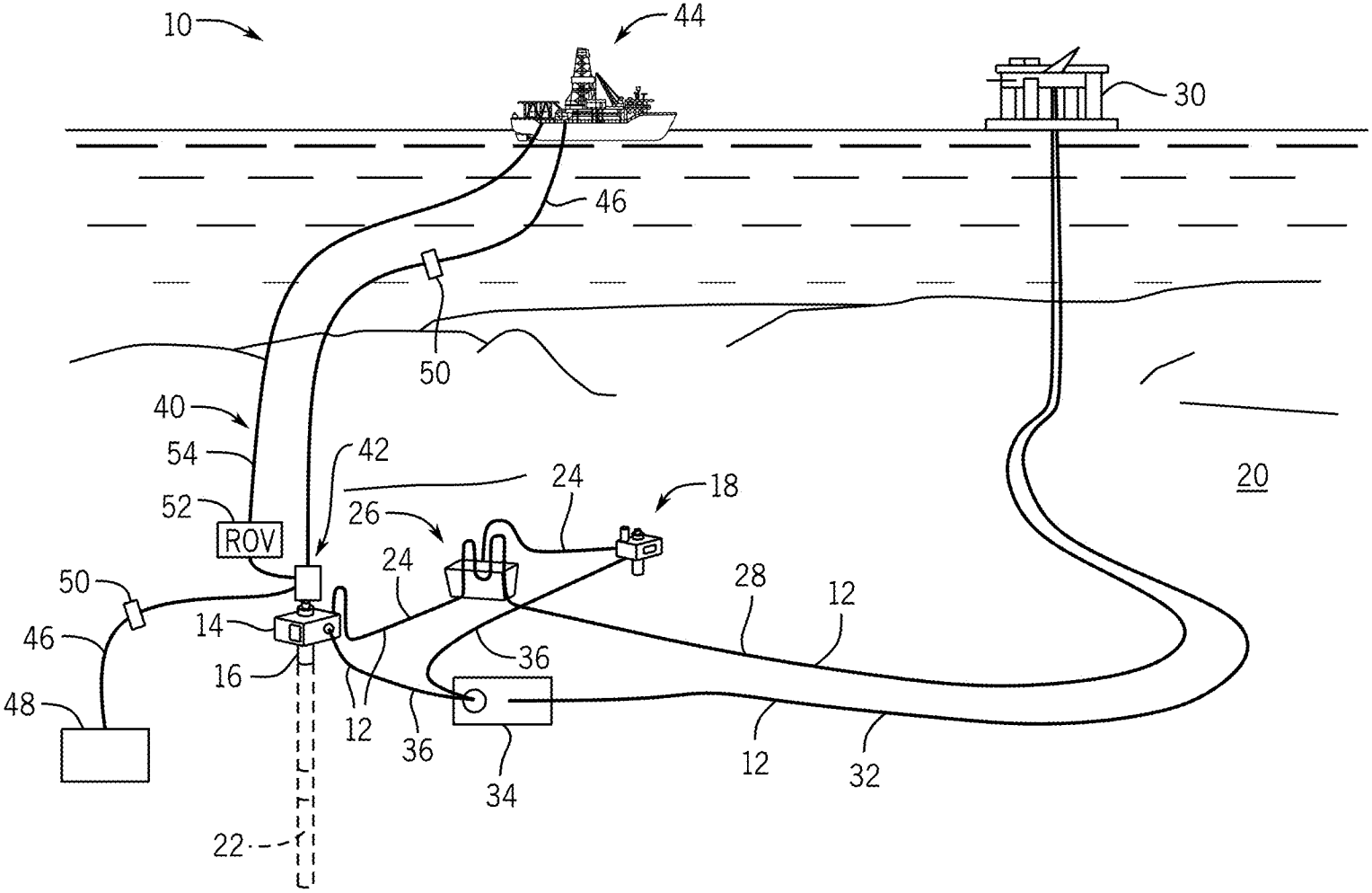
FIG. 1 is a schematic view of a subsea system having an intervention system used to improve and/or restore productivity of a subsea well, in accordance with an embodiment of the present disclosure.

Certain embodiments commensurate in scope with the present disclosure are summarized below. These embodiments are not intended to limit the scope of the disclosure, but rather these embodiments are intended only to provide a brief summary of certain disclosed embodiments. Indeed, the present disclosure may encompass a variety of forms that may be similar to or different from the embodiments set forth below.

As used herein, the term "coupled" or "coupled to" may indicate establishing either a direct or indirect connection (e.g., where the connection may not include or include intermediate or intervening components between those coupled), and is not limited to either unless expressly referenced as such. The term "set" may refer to one or more items. Wherever possible, like or identical reference numerals are used in the figures to identify common or the same elements. The figures are not necessarily to scale and certain features and certain views of the figures may be shown exaggerated in scale for purposes of clarification.

As used herein, the terms "inner" and "outer"; "up" and "down"; "upper" and "lower"; "upward" and "downward"; "above" and "below"; "inward" and "outward"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members.

Furthermore, when introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment," "an embodiment," or "some embodiments" of the present disclosure are not intended to be interpreted as excluding the existence of additional embodiments that also incorporate the recited features. Furthermore, the phrase A "based on" B is intended to mean that A is at least partially based on B. Moreover, unless expressly stated otherwise, the term "or" is intended to be inclusive (e.g., logical OR) and not exclusive (e.g., logical XOR). In other words, the phrase A "or" B is intended to mean A, B, or both A and B.

As used herein, the term "processing system" refers to an electronic computing device such as, but not limited to, a single computer, virtual machine, virtual container, host, server, laptop, and/or mobile device, or to a plurality of electronic computing devices working together to perform the function described as being performed on or by the computing system. As used herein, the term "medium" refers to one or more non-transitory, computer-readable physical media that together store the contents described as being stored thereon. Embodiments may include non-volatile secondary storage, read-only memory (ROM), and/or random-access memory (RAM).

In addition, as used herein, the terms "real time," "real-time," or "substantially real time" may be used interchangeably and are intended to describe operations (e.g., computing operations) that are performed without any human-perceivable interruption between operations. For example, as used herein, data relating to the systems described herein may be collected, transmitted, and/or used in control computations in "substantially real time" such that data readings, data transfers, and/or data processing steps occur once every second, once every 0.1 second, once every 0.01 second, or even more frequent, during operations of the systems (e.g., while the systems are operating). In addition, as used herein, the terms "continuous," "continuously," or "continually" are intended to describe operations that are performed without any significant interruption. For example, as used herein, control commands may be transmitted to certain equipment every five minutes, every minute, every 30 seconds, every 15 seconds, every 10 seconds, every 5 seconds, or even more often, such that operating parameters of the equipment may be adjusted without any significant interruption to the closed-loop control of the equipment. In addition, as used herein, the terms "automatic," "automated," "autonomous," and so forth, are intended to describe operations that are performed are caused to be performed, for example, by a computing system (i.e., solely by the computing system, without human intervention). Indeed, although certain operations described herein may not be explicitly described as being performed continuously and/or automatically in substantially real time during operation of the computing system and/or equipment controlled by the computing system, it will be appreciated that these operations may, in fact, be performed continuously and/or automatically in substantially real time during operation of the computing system and/or equipment controlled by the computing system to improve the functionality of the computing system (e.g., by not requiring human intervention, thereby facilitating faster operational decision-making, as well as improving the accuracy of the operational decision-making by, for example, eliminating the potential for human error), as described in greater detail herein.

As described above, intervention packages may be used in subsea environments to control fluids entering and/or exiting a subterranean well. As such, intervention packages may include valve(s) to control fluid flow during hydraulic or mechanical intervention. The intervention packages may include sensors to monitor the fluid and the subsea environment. Unfortunately, intervention packages may include hydraulic actuators coupled to valves to control fluid flow during intervention processes, wherein the hydraulic actuators may limit automation and/or precision of control of the intervention package. For example, the hydraulic actuators may drive a piston in a cylinder using hydraulic fluid, which results in a lack of precision movements of the valve. Additionally, the hydraulic actuators generally require a hydraulic fluid source, such as an accumulator, which adds costs, size, and weight to the overall intervention packages. As such, there is a need for electrification of valves within the intervention packages to increase precision movements of the valves and provide operation wirelessly, acoustically, and/or via other remote methods.

Accordingly, techniques of the present disclosure may be used to electrically operate and control valves within subsea intervention packages. An intervention system is described herein that may include an intervention package with one or more electric valves (e.g., valves with electric actuators) to control fluid flow during subsea intervention. The intervention package is generally a self-contained, retrievable package that is separate from other subsea equipment, such as a subsea tree. The intervention package may be used to provide control between a subsea tree (e.g., Christmas tree, XT) and/or a fluid reservoir and a vessel and/or a remote operating vehicle (ROV). As such, the intervention package may be a subsea safety module that provides access to a subsea well via a wireline and/or coiled tubing at various depths (e.g., less than or equal to approximately 10,000 ft). In some embodiments, the intervention package may be coupled to a riser (e.g., a jumper). As such, the intervention package may include one or more riser connectors. The riser connectors may include an electrically actuated disconnect (EQD). The riser may be connected to the vessel and may be used to provide fluids to the subterranean well. In some embodiments, the riser may disconnect from the intervention package using the EQD. The intervention package may be further coupled to the subsea tree. The intervention system may be compatible for interface with various types of subsea wells (e.g., horizontal trees, vertical trees), various fluid reservoirs, and the like. In some embodiments, the intervention package may be retrievable. The intervention package may be used for intervention processes occurring for a certain duration (e.g., days, weeks). As such, the intervention package may be installed via a remote operating vehicle (ROV). In this manner, the intervention package may be used in various contexts to support well intervention at various locations.

In some embodiments, connection between the intervention package and the riser and/or the subsea tree may be monitored by a controller (e.g., a processor-based control system). The control system may include local and/or remote monitoring of conditions of the intervention system, such as the intervention package, the riser, the subsea tree, the subsea well, or a combination thereof. In certain embodiments, the control system of the intervention system may control the electric valves to control fluid flow between the vessel and the subsea tree. In this manner, the intervention system may control the flow of well stimulation fluids, acids, scale inhibitors, diesel, reservoir chemicals, well kill, heavy fluids, and the like. As such, the control system may provide fluid to the subsea tree in a controlled manner. In some instances, the intervention system may be used to monitor conditions of the risers, the subsea tree, the fluid reservoir, or a combination thereof to ensure accurate control of fluid flow during intervention processes.

In some embodiments, the control system of the intervention system may control the electric valves of the intervention package to operate automatically. In this manner, automatic control of the intervention system may be based on a predetermined procedure that may instruct actuation of the electric valves. As such, the intervention system may be controlled to disconnect (e.g., electrical and mechanical disconnect) from the riser based on feedback provided by the electric actuators, the sensors, or a combination thereof. For example, the electric actuators may sense a change (e.g., pressure, resistance, additional signals) and disconnect the intervention package from the riser. As such, the electric actuators of the intervention package may close the electric valves based on a loss of communication with the vessel, the ROV, the subsea tree, the fluid reservoir, or a combination thereof. In certain embodiments, the control system may be communicatively connected to the intervention package via an electrical tether, a fiber optic tether, or may be controlled from a surface or locally via the ROV. In this manner, the control system may transmit data to the surface and/or the ROV to provide insight to operations of the intervention system.

In certain embodiments, the intervention system may control the electric valves to improve fine tuning of fluid flow within the intervention package. Electric actuation of the electric valves may provide improved granularity in fluid flow based on direct control of electric valve actuation by the control system. Additionally and/or alternatively, the electric valves may be operated independently. As such, the intervention system may independently control the electric valves based on feedback from the electric actuators, sensors, and the like. In some instances, the intervention system may perform an emergency disconnect process to disconnect the riser from the intervention system. In this manner, the intervention system may respond in real-time to conditions of the subsea well, the subsea tree, the vessel, or a combination thereof.

In some embodiments, the intervention system may control a flowrate of fluids entering and/or exiting the subsea tree and/or the fluid reservoir. Further, the intervention package may be lighter as the electric valves may be controlled via one or more batteries without accumulation systems. In this manner, the intervention system described herein may increase an efficiency and simplify intervention processes through use of electric valves.

With the foregoing in mind, FIG. 1 is a schematic diagram of a subsea system 10 with an intervention system 40 used to improve and/or restore productivity of a subsea well. The subsea system 10 located in an underwater location may include electrical cables 12 used for transmitting information and primary electrical power for various subsea components (e.g., pumps, compressors, valves, tools, actuators, sensors, etc.). The subsea system 10 may also include a subsea hydrocarbon production system configured to extract oil or gas from a subterranean reservoir, a subsea fluid injection system configured to inject fluid (e.g., liquid or gas) into a subterranean reservoir, or any other subsea system associated with subterranean reservoirs. In certain embodiments, the subsea system 10 may include a subsea tree 14 (e.g., Christmas tree, tree, XT) coupled to a wellhead 16 to form a subsea station 18 configured to extract and/or inject fluids relative to a subterranean reservoir. For example, the subsea station 18 may be configured to extract formation fluid, such as oil and/or natural gas, from the sea floor 20 through the subterranean well 22 (e.g., subsea well). In some embodiments, the subsea system 10 may include multiple subsea stations 18 that extract and/or inject fluids relative to respective subterranean wells 22.

In embodiments of the subsea system 10 configured for production, after passing through the subsea tree 14, the formation fluid flows through fluid conduits or pipes 24 to a pipeline manifold 26. The pipeline manifold 26 may connect to one or more flowlines 28 to enable the formation fluid to flow from the subterranean wells 22 to a surface platform 30. In some embodiments, the surface platform 30 may include a floating production, storage, and offloading unit (FPSO) or a shore-based facility. In addition to flowlines 28 that carry the formation fluid away from the subterranean wells 22, the subsea system 10 may include lines or conduits 32 that supply fluids, as well as carry control and data lines to the subsea equipment. These conduits 32 connect to a distribution module 34, which in turn couples to the subsea stations 18 via supply lines 36. In some scenarios, the surface platform 30 may be located a significant distance (e.g., greater than 100 m, greater than 1 km, greater than 10 km, or greater than 60 km) away from the subterranean wells 22. The subsea system 10 (e.g., the subsea tree 14, the subsea station 18, the pipeline manifold 26, and/or the distribution module 34) may include a subsea power system (e.g., subsea power bus system) that provides secondary power from energy storage units (e.g., batteries, fuel cells, or super capacitors (for initial actuator movement)) over one or more buses to various subsea components (e.g., actuators, sensors, etc.). For example, the subsea power system may be configured to provide secondary power, such as during a power loss from the primary power from the electrical cables 12, to operate various valves, sensors, and other subsea components. While the subsea system described above is for extracting hydrocarbons, it should be understood that the present disclosure may also apply to other types of subsea systems 10 such as subsea injection systems (e.g., subsea gas injection system, subsea water injection system, subsea carbon dioxide injection system).

In some embodiments, the intervention system 40 of the subsea system 10 may include an intervention package 42 coupled to the subsea tree 14. As shown, the intervention package 42 may be coupled via a light well intervention cap (e.g., positioned directly on the subsea tree 14) to inject fluids directly into the subsea tree 14. In some embodiments, the intervention package 42 may be coupled to the subsea tree 14 via an access point on the subsea tree 14. The access point of the subsea tree 14 may provide vertical and/or horizontal mounting configurations for the intervention package 42 to couple with the subsea tree 14. The intervention package 42 may be used to control a flow of fluid between the subsea tree 14 and a vessel 44 via one or more risers 46. In some embodiments of the subsea system 10, the intervention package 42 may be implemented on surfaces of the underwater equipment of the subsea system 10 including but not limited to the subsea tree 14, the subsea station 18, the pipeline manifold 26, the distribution module 34, the fluid reservoir and/or pump 48, valves, blowout preventers (BOPs), pumps, compressors, pipelines, or any combination thereof. As discussed in more detail below, the intervention package 42 is positioned on various surfaces of the underwater equipment allowing flow of fluid between the subsea tree 14 and the vessel 44 and/or the fluid reservoir and/or pump 48.

In some embodiments, the intervention package 42 may be used to control a flow of fluid between the intervention package 42 and the fluid reservoir and/or pump 48 via the risers 46. The risers 46 may include one or more disconnects 50 (e.g., electrically actuated disconnect, mechanical disconnect). The disconnect 50 may be used to disconnect the risers 46 from the intervention package 42. In certain embodiments, a ROV 52 may be used to set-up, provide maintenance, control, disconnect, and the like to the intervention system 40. In this manner, the ROV 52 may be used to mount, remove, or service the intervention system 40 of the subsea system 10 by coupling the ROV 52 to the intervention package 42. The ROV 52 may be coupled to the vessel 44 via a tether 54 (e.g., electric tether, fiber optic tether). In some instances, the ROV 52 may be remotely controlled without the tether 54. The ROV 52 may include a controller that may be communicatively connected to the intervention package 42 and/or the vessel 44. For example, the ROV 52 may be wirelessly connected to the intervention package 42 to control fluid flow between the vessel 44 and the subsea tree 14. Additionally and/or alternatively, the intervention system 40 may be controlled wirelessly from the vessel 44, the surface platform 30, or a combination thereof.

Figure 2:
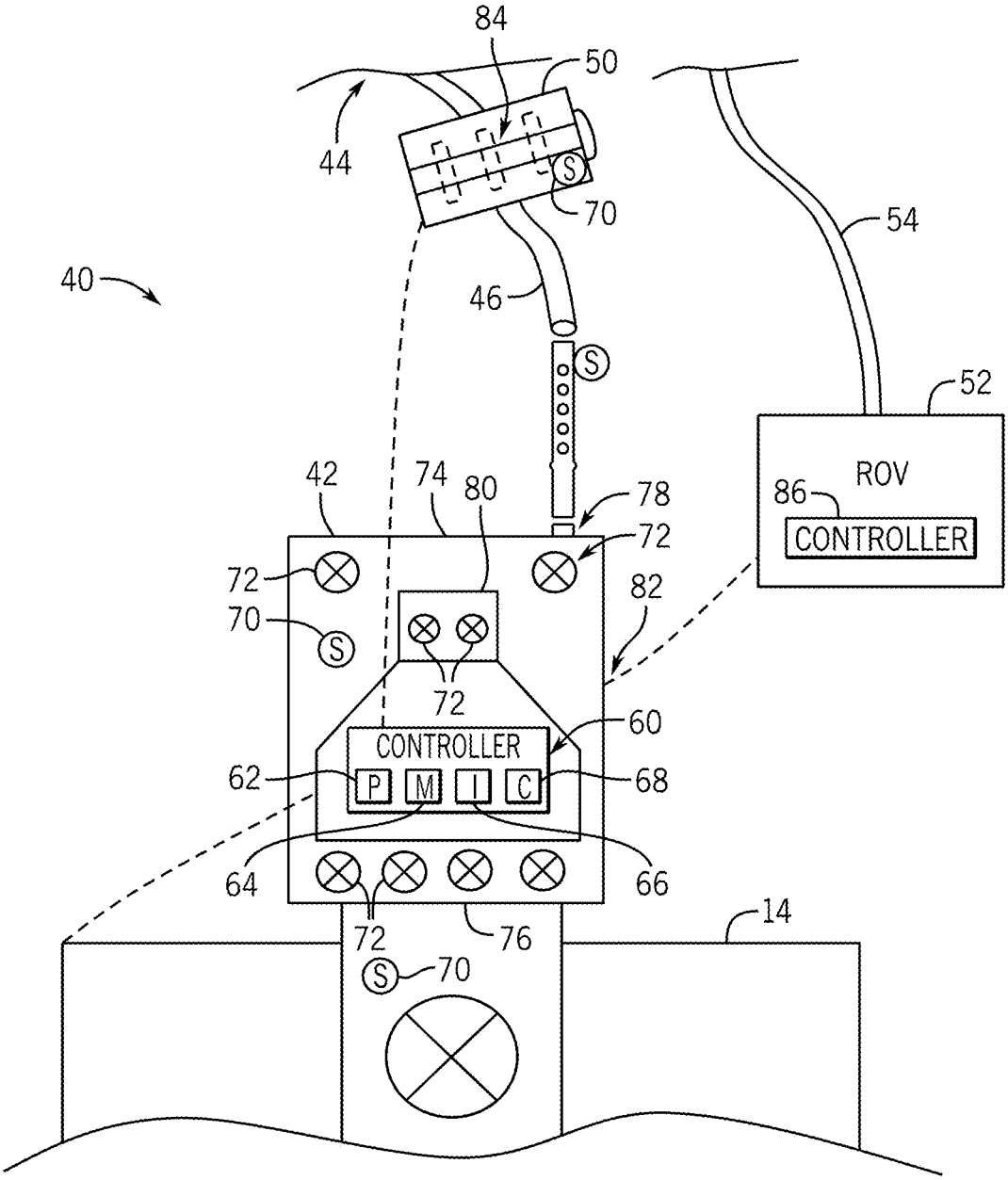
FIG. 2 is a schematic diagram illustrating the intervention system of FIG. 1 coupled to a subsea tree, in accordance with an embodiment of the present disclosure.

FIG. 2 is a schematic diagram illustrating the intervention system 40 of FIG. 1 coupled to a subsea tree 14. The intervention system 40 may include an intervention package 42 coupled to a riser 46 and the subsea tree 14. The intervention system 40 may include an ROV 52 coupled to a tether 54. In some embodiments, the ROV 52 may be used to control intervention processes performed by the intervention system 40. The intervention package 42 may include a controller 60. In some embodiments, the controller 60 may be communicatively coupled to various components, actuators, and sensors of the intervention system 40. The controller 60 may include a processor 62, a memory 64, instructions 66, and communication circuitry 68 configured to communicate with sensors and various equipment of the intervention system 40. For example, the controller 60 may be configured to receive sensor feedback from one or more sensors 70 coupled to the intervention package 42, the riser 46, the subsea tree 14, the ROV 52, and/or additional components of the intervention system 40 and control said equipment based on sensor feedback data, operating modes, user inputs, computer models, or any combination thereof.

In some embodiments, the sensors 70 of the intervention system 40 may measure one or more parameters (e.g., fluid parameters), such as a fluid temperature, a fluid pressure, a fluid flow rate, a fluid composition, or any combination thereof, as fluid enters and/or exits the subsea tree 14 through the intervention package 42. Thus, the sensors 70 may include, temperature sensors, pressure sensors, flow rate sensors, fluid composition sensors, or a combination thereof. The sensors 70 may provide sensor feedback data related to one or more parameters of fluid flow through one or more electric valves 72 of the intervention package 42. The electric valves 72 may include one or more gate valves, ball valves, flapper valves, needle valves, butterfly valves, diaphragm valves, pinch valves, choke valves, or any combination thereof. As discussed in detail below, the electric valves 72 include electrical actuators configured to move the valves between open and closed positions. The electric valves 72 may be controlled based on a variety of sensor feedback from the sensors 70. For example, the sensors 70 may include surface sensors (Internet of Things (IoT) sensors, gauges, and so forth. The sensors 70 may be used to control electric actuation of the electric valves 72 of the intervention package 42 to control fluid to or from the subsea tree 14.

In some embodiments, the sensors 70 may include a fluid test meter, such as a multiphase flow meter (e.g., using full gamma spectroscopy) configured to measure a flowrate of fluid flowing within the intervention system 40. In some embodiments, the sensors 70 may be included in the riser 46 between the vessel 44 and the intervention package 42. Additionally and/or alternatively the sensors 70 may be positioned in the disconnect 50 to monitor conditions of fluid flow between the vessel 44 and the intervention package 42. In some embodiments, the sensors 70 may be included in the subsea tree 14. The sensors 70 may include a plurality of sensor modules, a first module may be a flow meter and a second module may be a conductivity sensor, a pressure sensor, and the like. The modules may be used to derive directly or indirectly conditions of fluid used in intervention processes.

The intervention package 42 may include a housing 74, a subsea tree interface 76, a riser interface 78, a flow regulator 80, a ROV interface 82, one or more additional components, or a combination thereof. The housing 74 may be substantially watertight (e.g., sealed housing) to maintain separation of the intervention package 42 and sea water. The subsea tree interface 76 may be used to couple the intervention package 42 to the subsea tree 14. As such, the subsea tree interface 76 may include pins, latches, fluid connectors (e.g., inlets, outlets). In this manner, the intervention package 42 may be electrically, fluidly, and/or mechanically coupled to the subsea tree 14. The riser interface 78 may be used to couple to the intervention package 42 to the risers 46 that may be provided from the vessel 44 and/or the surface platform 30. The riser interface 78 may include pins, latches, fluid connectors (e.g., inlets, outlets), and the like. In some instances, the riser interface 78 may be fluidly coupled to the disconnect 50. In certain embodiments, the disconnect 50 may be integrated with and/or part of the riser interface 78. As such, the disconnect 50 may include one or more fasteners or connectors 84, such as mating mechanical connectors, mating electrical connectors, and mating fluid connectors. The connectors 84 may be coupled via axial engagement with one another (e.g., axial connectors), rotary engagement with one another (e.g., rotary connectors), or any combination thereof. For example, the connectors 84 may include male axial connectors (e.g., pins) that mate with female axial connectors (e.g., receptacles) for the mechanical, fluid, and/or electrical connectors. The disconnect 50 may include one or more actuators (e.g., electrical actuators) that moves the connectors 84 from a connected position to a disconnected position, such as in response to control by the controller 60. As such, the intervention system 40 may control the disconnect 50 to facilitate emergency disconnect procedures, such as in response to issues with the riser 46, the electric valves 72, or a combination thereof. For example, the disconnect 50 may include a sensor 70. As such, the sensor 70 may provide sensor feedback data indicative of emergency shut-off conditions. In this manner, the connectors 84 of the disconnect 50 may be controlled by the intervention system 40 to disconnect the riser 46 from the riser interface 78 of the intervention package 42.

In some embodiments, the flow regulator 80 of the intervention package 42 may regulate or control a flow parameter, such as a volumetric flow rate, a mass flow rate, a volume, and/or a mass of fluid flowing between the intervention package 42 and the subsea tree 14. In operation, the controller 60 may control fluid flow through the flow regulator 80. The controller 60 may transmit a control signal to the valves 72. The control signal may be based on a comparison between a flow parameter (e.g., a volumetric flow rate, a mass flow rate, a volume, or a mass) measured by the sensors 70 and a desired value of the flow parameter. For instance, if the controller 60 determines that the flow rate through the flow regulator 80 is less than a desired flow rate, the controller 60 may signal the valves 72 to open. Alternatively, if the controller 60 determines that the flow rate (or other flow parameter) through the flow regulator 80 is greater than a desired flow rate (or other flow parameter), then the controller 60 may signal the valves 72 to close, decreasing the flow rate.

The ROV interface 82 of the intervention package 42 may include electrical connectors, fluid connectors, mechanical connectors, or a combination thereof. Accordingly, the ROV interface 82 may include fasteners, apertures, slots, latches, clamps, pins, and the like. In some embodiments, the ROV interface 82 may be communicatively coupled to the intervention package 42. In this manner, the ROV 52 may include a ROV controller 86. The ROV controller 86 may be communicatively coupled to the controller 60, one or more additional controllers of the vessel 44, or a combination thereof.

In some embodiments, the controller 60, the ROV controller 86, or a combination thereof, may be used to control fluid flow of the intervention system 40. For example, the controller 60 may be used to receive and analyze sensor feedback data, predictive data, historical data, and the like, directly or via a network. The controller 60 may include the processor 62, the memory 64, the instructions 66, the communication circuitry 68, data storage, input/output (I/O) ports, a display, and the like. The network may include transceivers, receivers, and/or transmitters to facilitate data communication to and/or from the controller 60. For example, flow rates from the sensors 70 may be transmitted to the controller 60 through the network. Further, external data (e.g., data about the subsea tree 14, the subterranean well) may be gathered from a remote system and transmitted to the controller 60 via the network. However, in some embodiments, data may be transmitted directly from the sensors 70 and/or the electric valves 72 coupled to one or more components of the intervention system 40. Indeed, the controller 60 may communicate with the components directly and/or through the network in accordance with present embodiments. In certain embodiments, flow data may be automatically communicated from the sensors 70 to the controller 60 for analysis in real-time, thereby enabling real-time responses (e.g., adjusting flow rates of the intervention package 42, initiating shut-down procedures, controlling emergency disconnect of the disconnect 50, etc.) to information obtained from analysis of the flow data.

The communication circuitry 68 may be a wireless or wired communication component (e.g., circuitry) that may facilitate communication between the controller 60, various types of devices, components of the intervention system 40, the network, the ROV 52, the vessel 44, the surface platform 30, and the like. Additionally, the communication circuitry 68 may facilitate data transfer to the controller 60, such that the controller 60 may receive data from the other components depicted in FIG. 1 and the like. The communication circuitry 68 may use a variety of communication protocols, such as Open Database Connectivity (ODBC), TCP/IP Protocol, Distributed Relational Database Architecture (DRDA) protocol, Database Change Protocol (DCP), HTTP protocol, other suitable current or future protocols, or combinations thereof.

The processor 62 may include single-threaded processor(s), multi-threaded processor(s), or both. The processor 62 may process instructions stored in the memory 64. The processor 62 may also include hardware-based processor(s) each including one or more cores. The processor 62 may include general purpose processor(s), special purpose processor(s), or both. The processor 62 may be communicatively coupled to other internal components (such as the communication circuitry 68, the data storage, the I/O ports, and the display).

The memory 64 and the data storage may be any suitable articles of manufacture that can serve as media to store processor-executable code, data, or the like. These articles of manufacture may represent computer-readable media (e.g., any suitable form of memory or storage) that may store the processor-executable code used by the processor 62 to perform the presently disclosed techniques. As used herein, applications may include any suitable computer software or program that may be installed onto the controller 60 and executed by the processor 62. The memory 64 and the data storage may represent non-transitory computer-readable media (e.g., any suitable form of memory or storage) that may store the processor-executable code used by the processor 62 to perform various techniques described herein. It should be noted that non-transitory merely indicates that the media is tangible and not a signal.

The I/O ports may be interfaces that may couple to other peripheral components such as input devices (e.g., keyboard, mouse), sensors, input/output (I/O) modules, and the like. The display may operate as a human machine interface (HMI) to depict visualizations associated with software or executable code being processed by the processor 62. The display may display a flow diagram of the intervention system 40 corresponding to intervention processes, alerts/alarms, recommendations associated with the alerts/alarms, etc. In one embodiment, the display may be a touch display capable of receiving inputs from an operator of the controller 60. The display may be any suitable type of display, such as a liquid crystal display (LCD), plasma display, or an organic light emitting diode (OLED) display, for example. Additionally, in one embodiment, the display may be provided in conjunction with a touch-sensitive mechanism (e.g., a touch screen) that may function as part of a control interface for the controller 60.

It should be noted that the components described above with regard to the intervention system 40 are exemplary components and the intervention system 40 may include additional or fewer components as shown. In addition, although the components are described as being part of the controller 60, the components may also be part of any suitable computing device described herein such as the ROV controller 86 of the ROV 52, controllers of the vessel 44, and the like to perform the various operations described herein.

Figure 3:
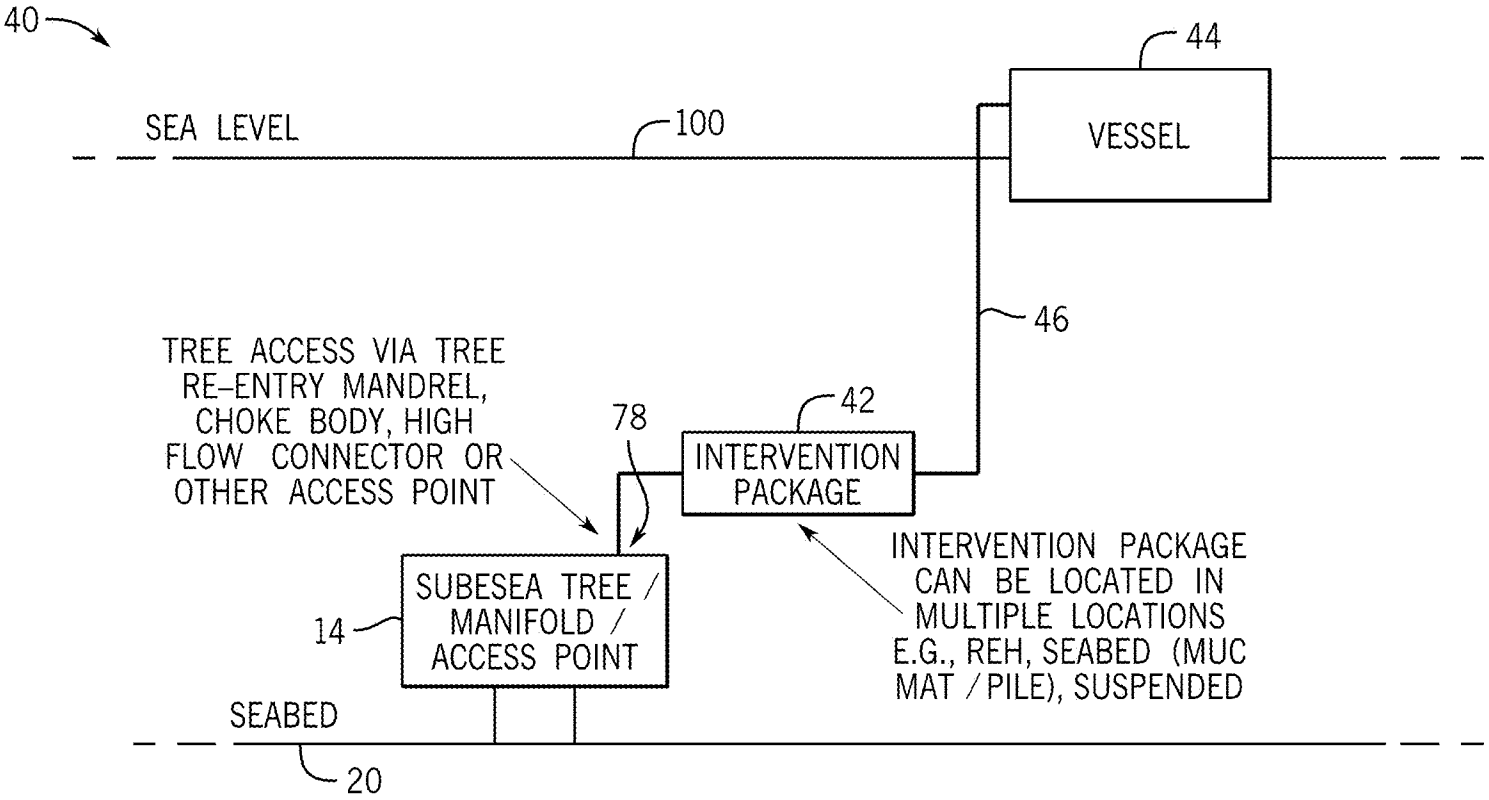
FIG. 3 is a schematic diagram of an intervention system having an intervention package in connection with a vessel, in accordance with aspects of the present disclosure.

FIG. 3 is a schematic diagram of an intervention system 40 having an intervention package 42 in connection with a vessel 44. As shown, the intervention system 40 includes the intervention package 42 coupled to the vessel 44 via the riser 46. The intervention package 42 is further coupled to the subsea tree 14 positioned on the sea floor 20 (e.g., seabed) via the riser interface 78. As shown, the intervention package 42 may be suspended in the sea water between the vessel 44 positioned at a surface 100 and the subsea tree 14. In some embodiments, the intervention package 42 may be positioned directly on the subsea tree 14, the sea floor 20, a mud mat, a subsea tree re-entry hub, and the like.

Figure 4:
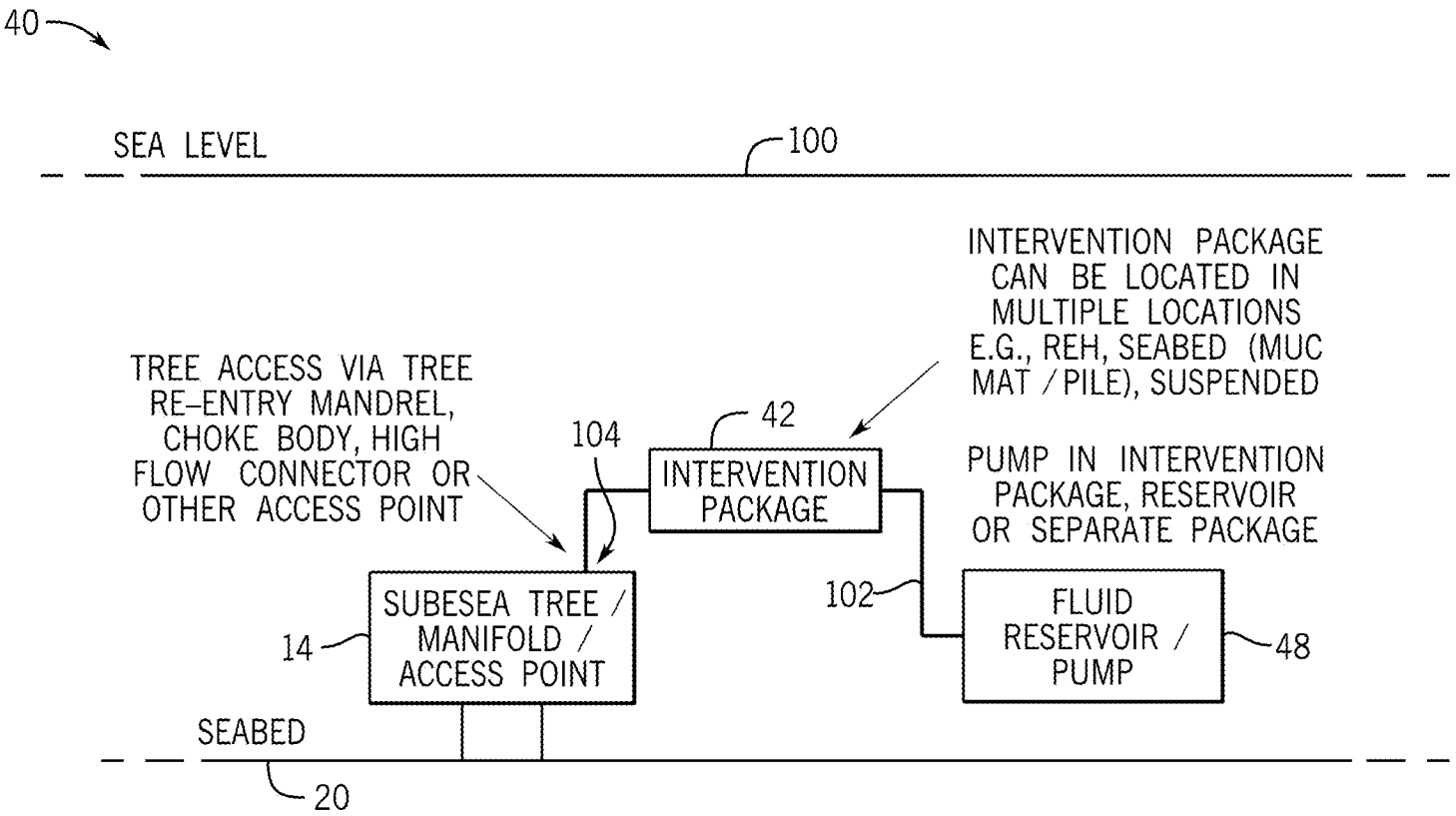
FIG. 4 is a schematic diagram of an intervention system having an intervention package in connection with a fluid reservoir, in accordance with an embodiment of the present disclosure.

FIG. 4 is a schematic diagram of an intervention system 40 having an intervention package 42 in connection with a fluid reservoir and/or pump 48. As shown, the intervention system 40 includes the intervention package 42 coupled to the fluid reservoir and/or pump 48 positioned on the sea floor 20 via a jumper 102. The jumper 102 may include a segment of flexible pipes and one or more connectors. The fluid reservoir and/or pump 48 may receive and/or provide fluid to the intervention package 42. The intervention package 42 is further coupled to the subsea tree 14 positioned on the sea floor 20 via a jumper interface 104. In some embodiments, the jumper interface 104 may include various pins, fasteners, inlets, and the like. As shown, the intervention package 42 may be suspended in the sea water between the vessel 44 positioned at a surface 100 and the subsea tree 14. In some embodiments, the intervention package 42 may be positioned directly on the subsea tree 14, the sea floor 20, a mud mat, a subsea tree re-entry hub, and the like.

Figure 5:
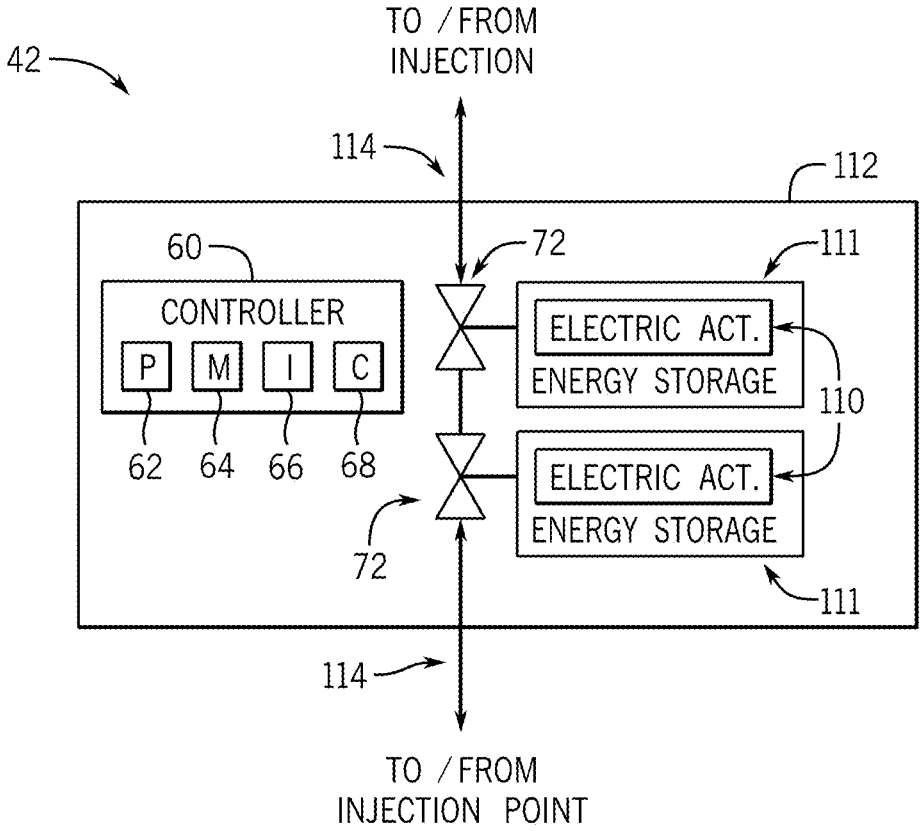
FIG. 5 is a schematic diagram of the intervention package of FIGS. 3 and 4, in accordance with an embodiment of the present disclosure.

FIG. 5 is a schematic diagram of the intervention package 42 of FIGS. 3 and 4. The controller 60 may include the one or more electric valves 72 arranged in series, in parallel, or a combination thereof, along a fluid flow path through the intervention package 42. Each of the electric valves 72 may be controlled by an electric actuator 110. It should be noted, that in some embodiments, a single electric actuator 110 may control a plurality of electric valves 72. The electric actuators 110 may provide linear actuation, rotary actuation, or a combination thereof, of the electric valves 72. In certain embodiments, the electric actuator 110 includes threading and/or gearing to provide precision control of the valve position of the electric valves 72. For example, in certain embodiments, the electric actuator 110 may include an electric motor that rotates a shaft having external threads (e.g., male threaded shaft) relative to a linearly movable body having internal threads (e.g., female threaded body), thereby converting rotational motion of the electric motor into linear motion of the linearly movable body coupled to the electric valve 72. In certain embodiments, the electric actuator 110 may include an electric motor coupled to a gear assembly or transmission, which is configured to convert the rotational motion of the electric motor into linear motion of the electric valve 72. For example, the gear assembly may include a planetary gear assembly having a sun gear, a plurality of planet gears disposed about the sun gear, and a ring gear disposed about the plurality of planet gears. By further example, the gear assembly may include a rack and pinion assembly having a circular gear or pinion driven to rotate by the electric motor, while the pinion rotates along a linear gear or rack to convert the rotational motion of the pinion into linear motion of the rack. Thus, the electric actuator 110 may enable fine positional control of the electric valve 72, thereby enabling precision control of the flowrate through the intervention package 42. For example, the electric actuator 110 may enable precision control between continuously variable valve positions between 0 and 100 percent open position, or 0 and 100 percent closed position. By further example, the electric actuator 110 may enable a plurality of valve positions, such as setpoints, that can be rapidly and precisely achieved to enable rapid and precise flow control of the electric valve 72. By further example, depending on sensor feedback, the electric actuator 110 can precisely control the electric valve 72 in real-time to provide precise adjustments in response to variations in pressure, temperature, fluid composition, or any combination thereof. In certain embodiments, the controller 60, the ROV controller 86, and/or other controllers may coordinate control of the electric valves 72 of the intervention package 42 with other flow controls (e.g., electric valves, pumps, chokes, etc.) in the subsea tree 14, downhole equipment in the wellbore (e.g., pumps, tools, etc.), or any combination thereof. Thus, if other electric valves and/or electric flow controls are employed at the wellsite, the electric valves 72 may further improve the precision of flow control and enhance well operations.

In some embodiments, the electric actuators 110 may include and/or couple to energy storage 111, such as a battery, a super capacitor, or a combination thereof. The energy storage 111 may power actuation of the electric actuators 110 of the electric valves 72. In certain embodiments, the energy storage 111 may be integrated and/or dedicated only to the electric valves 72. In some embodiments, the energy storage 111 may be configured to provide power to the electric valves 72, the controller 60, sensors 70, the disconnect 50, and/or other components of the intervention package 42. In some embodiments, the energy storage 111 may be rechargeable by one or more electrical generators, such as a fluid driven turbine generator, a geothermal power plant, or a combination thereof, which may be part of or separate from the intervention package 42. For example, the electrical generators may be integrated within the intervention package 42, such as along the same fluid flow path as the electric valves 72. In some embodiments, the electrical generators may be integrated with the electric valves 72. Thus, the intervention package 42 may be configured to maintain sufficient power to operate the electric valves 72 by generating power sufficient to maintain a charge in the energy storage 111. However, in some embodiments, the intervention package 42 may exclude any electrical generators, and the power to charge the energy storage 111 may be supplied through the riser 46 and/or another source.

In some instances, the electric valves 72, the electric actuators 110, and the energy storage 111 may be positioned in a housing 112. The housing 112 may be positioned within the intervention package 42. The housing 112 may include one or more injection points 114. The injection points 114 may be used to provide fluid to flow through the electric valves 72 of the intervention package 42. As such, as the electric valves 72 are controlled by the electric actuators 110, the fluid flow may be decreased, increased, or otherwise varied. In certain embodiments, the intervention package 42 is a self-contained, retrievable unit that is configured to removably couple to various subsea equipment.

In some embodiments, the intervention package 42 may include the controller 60. In some embodiments, the controller 60 may be communicatively coupled to the electric actuators 110, the electric valves 72, sensors, and/or one or more additional components of the intervention system 40. The controller 60 may include the processor 62, the memory 64, instructions 66, and the communication circuitry 68 configured to communicate with sensors and various equipment of the intervention system 40.

Figure 6:
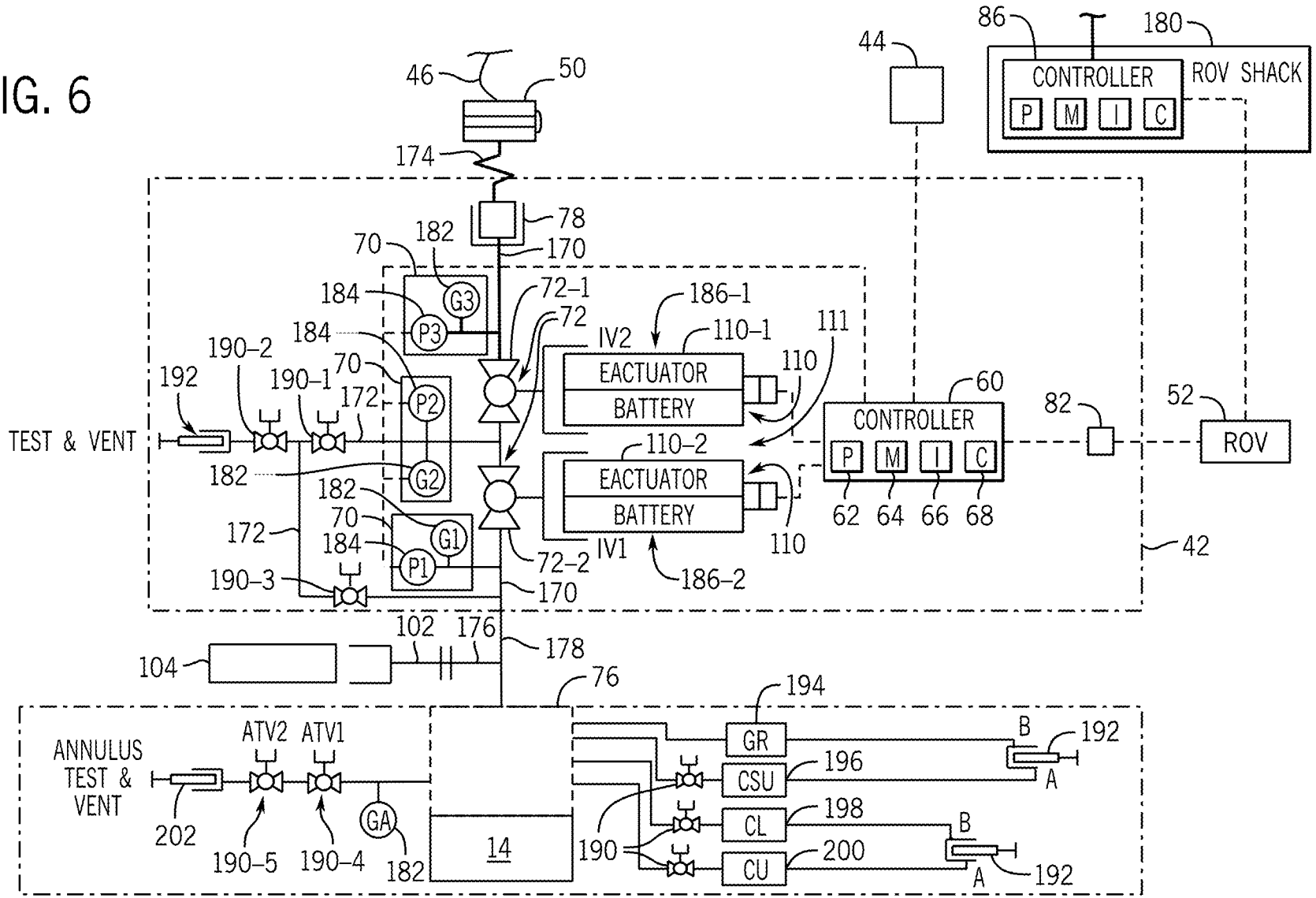
FIG. 6 is a schematic diagram of an intervention system including an intervention package with one or more electric valves, in accordance with an embodiment of the present disclosure.

FIG. 6 is a schematic diagram of an intervention system 40 including an intervention package 42 with one or more electric valves 72. The intervention system 40 may monitor a flow of fluid through a fluid path 170 including the electric valves 72. In some embodiments, the intervention system 40 may include one or more pressure test path 172 to monitor the pressure of fluid within the intervention package 42, detect one or more leaks within the intervention package, or a combination thereof. The intervention package 42 may be coupled to a riser 46 via a riser interface 78. The intervention package 42 may provide fluid via a riser fluid path 174. The intervention system 40 may be coupled to a jumper 102 via a jumper interface 104. As such, the intervention package 42 may provide and/or receive fluid via a jumper fluid path 176. The jumper interface 104 may be used to connect the intervention package 42 to the subsea tree 14 and/or other components of the subsea system 10. For example, the jumper interface 104 may be used to connect the intervention package 42 to a subsea tree 14 (e.g., a horizontal subsea tree). The intervention package 42 may be coupled to the subsea tree 14 (e.g., vertical subsea tree) via the subsea tree interface 76. In this manner, the intervention package 42 may provide and/or receive fluid via a subsea tree fluid path 178. The subsea tree interface 76 may be used to directly mount the intervention package 42 on the subsea tree 14. In some embodiments, when the intervention package 42 is coupled to the subsea tree 14 via the subsea tree interface 76, the jumper interface 104 may be plugged. The various fluid paths 170, 174, 176, 178 may be actuated (e.g., opened or closed) by control of the electric valves 72 and/or one or more additional valves via the one or more electric actuators 110. In some instances, the electric valves 72 may be controlled by a controller 60.

With this in mind, the intervention package 42 may include the controller 60, as described above in reference to FIG. 2. Briefly, the controller 60 may include the processor 62, the memory 64, the instructions 66, the communication circuitry 68, and the like. In some embodiments, the controller 60 may be used to operate the electric valves 72. Additionally and/or alternatively, the controller 60 may be communicatively coupled (e.g., wired, wireless) to the ROV 52. The ROV 52 may be controlled by the ROV controller 86. As shown, the ROV controller 86 may be located in a ROV shack 180. The ROV shack 180 may be on the surface 100, the vessel 44, the surface platform 30, and the like. In some embodiments, the ROV controller 86 may be positioned in the ROV 52. The ROV 52 may be tethered to the intervention package 42 via the ROV interface 82. As such, the ROV 52 may be used to control operations of the intervention package 42.

In certain embodiments, the controller 60 of the intervention package 42 may be operated remotely from the vessel 44. As such, the intervention package 42 may be controlled based on sensor feedback data generated during operation of the intervention system 40. For example, the intervention system 40 may include one or more sensors 70 that may provide pressure feedback, temperature feedback, fluid composition feedback, flowrate feedback, or any combination thereof, of fluid flowing through the various fluid paths 170, 174, 176, 178 of the intervention package 42. As such, the sensors 70 may include one or more pressure gauges 182 (e.g., visual display of pressure), one or more pressure transmitters 184, one or more additional types of sensors, or a combination thereof.

In some embodiments, the intervention package 42 may receive fluid flow via the riser fluid path 174 through the riser interface 78 into the fluid path 170. The intervention package 42 may be controlled by the controller 60 to directly allow fluid flow through the fluid path 170. As such, the controller 60 may open a first electric valve 72-1 and a second electric valve 72-2. Actuation of the electric valves 72 may be controlled by the electric actuators 110 and powered by the energy storage 111, such as one or more batteries 186. For example, the controller 60 may control the first electric valve 72-1 via a first actuator 110-1 powered by a first battery 186-1. Additionally and/or alternatively, the controller 60 may control the second electric valve 72-2 via a second actuator 110-2 powered by a second battery 186-2. As such, fluid may flow between the riser 46 and the intervention package 42 to the jumper 102 or the subsea tree 14.

In some embodiments, the intervention system 40 may control the intervention package 42 to determine pressure within the intervention package 42, detect one or more leaks, vent pressure in the fluid path 170, or a combination thereof. As such, the intervention package 42 may include the one or more pressure test paths 172. The intervention package 42 may measure one or more parameters (e.g., pressure, temperature) using the sensors 70 positioned on the pressure test path 172. For example, the pressure test path 172 may be used to determine if the first electric valve 72-1 and/or the second electric valve 72-2 is sealed or leakproof in a closed position. That is, the pressure test path 172 may be used to determine if the first electric valve 72-1 and/or the second electric valve 72-2 properly blocks fluid flow in the closed position in the intervention package 42. In certain embodiments, a pressure test is achieved by applying a fluid pressure along the pressure test path 172 leading to the target valve (e.g., first electric valve 72-1 or second electric valve 72-2) via a pressure test port 192, and then monitoring for changes (e.g., decreases) in the fluid pressure via the sensors 70. Thus, the pressure test port 192 may be configured to receive fluid pressure from a ROV or external fluid source. In some embodiments, a pressure test is achieved without applying a fluid pressure via the pressure test port 192. Instead, the sensors 70 are monitored for changes (e.g., increases) in the fluid pressure via the sensors 70. In either case, the pressure test involves isolating a portion of the pressure test path 172 adjacent to the target valve (e.g., first electric valve 72-1 or second electric valve 72-2). For example, the controller 60 may close at least an isolation test valve 190-1, and possibly all of the isolation test valves 190-1, 190-2, and 190-3, while testing the first electric valve 72-1. By further example, the controller 60 may close at least an isolation test valve 190-3, and possibly all of the isolation test valves 190-1, 190-2, and 190-3, while testing the second electric valve 72-2. While performing the pressure test, a constant pressure sensed by the sensors 70 may indicate a proper seal (e.g., no leakage) of the target valve (e.g., first electric valve 72-1 or second electric valve 72-2) whereas a variable pressure may indicate a leaky seal of the target valve (e.g., first electric valve 72-1 or second electric valve 72-2). After testing the electric valves 72-1 and 72-2, the controller may open the isolation test valves 190-1, 190-2, and 190-3 to vent any residual fluid pressure through the pressure test port 192.

In some embodiments, the subsea tree interface 76 may include sensors 70 and/or various fluid controls such as one or more additional pressure test ports 192, one or more gasket releases 194, a connector secondary unlock 196, a connector lock 198, one or more connector unlocks 200, or a combination thereof. The fluid controls may be used to control flow of fluid and/or control pressure build up between the subsea tree 14 and the intervention package 42. For example, the test/vent valves 190 may be used to test a pressure of an annulus of the subsea tree interface 76. As such, a fourth test/vent valve 190-4 and a fifth test/vent valve 190-5 may be controlled to release pressure to a annulus release valve 202. In this manner, fluid flow may be controlled on start-up, routine operation, decommission, shut-down, emergency shut-down, and the like of intervention processes conducted by the intervention system. In some embodiments, the subsea tree interface 76 may include a gasket. The gasket may be held in place with one or more hydraulic pins. As such, the gasket releases 194 may be actuated by pressure to retract the hydraulic pins to release the gasket. In this manner, the gasket may be replaced. In certain embodiments, the connector secondary unlocks 196 may be used as a backup hydraulic circuit to the connector unlock 200. The connector unlocks 200 may be used to unlock the intervention package 42 from the subsea tree interface 76. In some instances, the connector lock 198 may be used to connect the intervention package 42 to the subsea tree interface 76. In this manner, the connector secondary unlock 196, the connector lock 198, the connector unlocks 200, or a combination thereof may be used to couple the intervention package 42 to the subsea tree 14 via the subsea tree interface 76.

Figure 7:
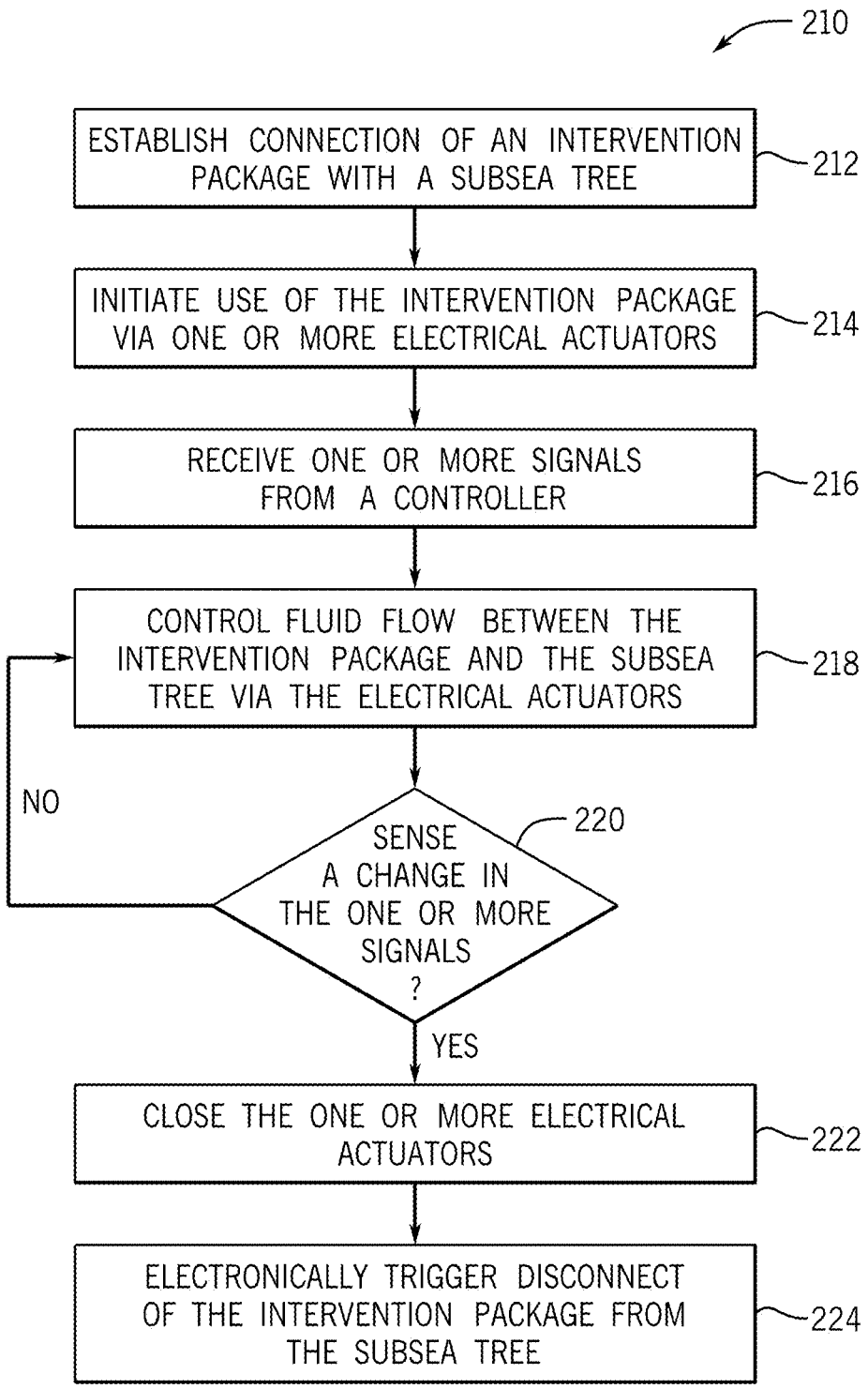
FIG. 7 is a flow chart of a process for operating an intervention system to control fluid flow via one or more electrical actuators, in accordance with an embodiment of the present disclosure.

With this in mind, FIG. 7 is a flow chart of a process 210 for operating an intervention system 40 to control fluid flow via one or more electrical actuators 110. The process 210 may be performed by a computing device or controller disclosed above with reference to FIG. 2 and FIG. 6 or any other suitable computing device(s) or controller(s). Furthermore, the blocks of the process 210 may be performed in the order disclosed herein or in any suitable order. For example, certain blocks of the process 210 may be performed concurrently. In addition, in certain embodiments, at least one of the blocks of the process 210 may be omitted.

At block 212 of the process 210, the intervention system 40 may establish a connection of an intervention package 42 with a subsea tree 14. Connection of the intervention package 42 with the subsea tree may be made via a subsea tree interface 76. In some embodiments, the ROV 52 may be used to facilitate connection of the intervention package 42 and the subsea tree 14. At block 214 of the process 210, the intervention system 40 may initiate use of the intervention package 42 via one or more electrical actuators 110. In some embodiments, the electrical actuators 110 may include and/or couple with the electric valves 72 and the batteries 186. Use of the intervention package 42 may include providing fluid flow between the intervention package 42 and the subsea tree 14. In some instances, the intervention package 42 may be coupled via a riser 46 to a vessel 44. Additionally and/or alternatively, the intervention package 42 may be coupled to a fluid reservoir and/or pump 48 via a jumper 102. In some embodiments, fluid may be provided to the subsea tree 14 through the intervention package 42 from the vessel 44. The vessel 44 may provide fluids that may be used to improve operation of the subsea tree 14. For example, fluids such as well stimulation fluids, acids, scale inhibitors, and/or additional reservoir chemical may be provided to the subsea tree 14 via the intervention package 42. In some embodiments, the subsea tree 14 may provide fluids to the fluid reservoir and/or pump 48 via the intervention package 42.

During operation of the intervention package 42, one or more sensors 70 may provide sensor feedback to the intervention system 40. In some instances, the sensor feedback data may include pressure data, temperature data, flowrate data, fluid composition data, and the like. Additionally and/or alternatively, the intervention package 42 may be operated using a controller 60. The controller 60 may be used to provide a predetermined operating procedure to the intervention package 42. As such, the intervention package 42 may operate based on a series of steps to provide intervention services to the subsea tree 14. In certain embodiments, the controller 60 may actively control operation of the intervention package 42. As such, at block 216 of the process 210, the intervention system 40 may receive one or more signals from the controller 60. The signals may include one or more electric signals from the electrical actuators 110, sensor feedback data, or a combination thereof. In some embodiments, the signals may be indicative of operational parameters of the intervention system 40.

At block 218 of the process 210, the intervention system 40 may control fluid flow between the intervention package 42 and the subsea tree 14 via the electrical actuators 110. In this manner, fluid may be controlled to flow between the riser 46 and the subsea tree 14. At block 220 of the process 210, the intervention system 40 may sense a change in the one or more signals. The change in the one or more signals may be a change in the electric signals of the electrical actuators 110, a change in pressure, a change in temperature, a change in flow rate, a change in fluid composition, or a combination thereof. In some embodiments, the intervention system 40 may not detect any change in the signals and return to block 218 of the process 210. In this manner, fluid flow between the intervention package 42 and the subsea tree 14 may be uninterrupted (e.g., unchanged).

In some embodiments, the intervention system 40 may sense a change in the one or more signals and proceed to block 222. At block 222 of the process 210, the intervention system may close the one or more electrical actuators 110. That is the one or more electric valves 72 may be closed by the intervention system 40. As such, fluid flow between the intervention package 42 and the subsea tree 14 may be reduced and/or stopped. In some embodiments, the intervention system 40 may adjust (e.g., open, vary, shut) the electric valves 72 based on the signals from the controller 60.

At block 224 of the process 210, the intervention system 40 may electronically trigger disconnect of the intervention package 42 from the subsea tree 14. Disconnect of the intervention package 42 from the subsea tree 14 may be electronically triggered by disconnecting the intervention package 42 at the subsea tree interface 76. In some embodiments, disconnect of the intervention package 42 from the subsea tree 14 may be facilitated by the ROV 52. The disconnect may include a disconnect of mechanical connectors, electrical connectors, and fluid connectors between the intervention package 42 and the subsea tree 14.

Figure 8:
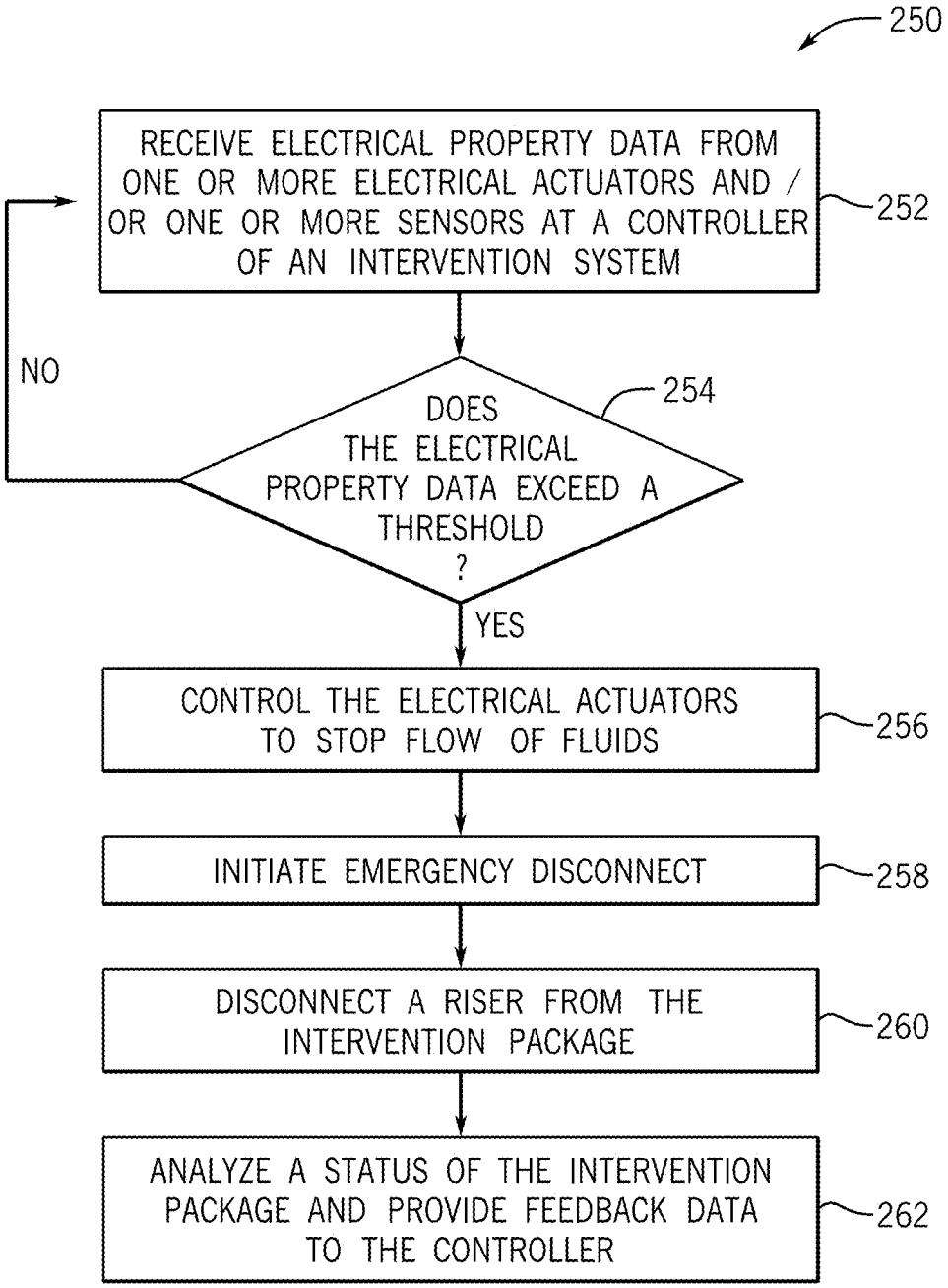
FIG. 8 is a flow chart of a process for disconnecting an intervention system from a riser, in accordance with an embodiment of the present disclosure.

FIG. 8 is a flow chart of a process 250 for disconnecting an intervention package 42 from a riser 46. The process 250 may be performed by a computing device or controller disclosed above with reference to FIG. 2 and FIG. 6 or any other suitable computing device(s) or controller(s). Furthermore, the blocks of the process 250 may be performed in the order disclosed herein or in any suitable order. For example, certain blocks of the process 250 may be performed concurrently. In addition, in certain embodiments, at least one of the blocks of the process 250 may be omitted.

At block 252 of the process 250, the intervention system 40 may receive electrical property data from one or more electrical actuators 110 and/or sensor feedback from one or more sensors 70 at a controller 60 of the intervention system 40. The electrical property data may include data indicative of a signal from the electrical actuators 110, the electric valves 72, the batteries 186, or a combination thereof. The sensor feedback from the sensors 70 may indicate a fluid pressure, a fluid temperature, a fluid composition, a fluid flow rate, or any combination thereof, of fluid flow through the intervention system 40. In some instances, the electrical property data may include a valve position of the electric valves 72, a resistance to movement of the electric valves 72, a health of the electric valves 72, a set point of the electric valves 72, and the like. For example, the health of the electric valves 72 may indicate unexpected operational behavior of the electric valves (e.g., not moving to target position, not responding to commands, etc.), wear of the electric valves 72 (e.g., erosion, corrosion, scale buildup, cracking, leaking, etc.), hours of operation of the electric valves 72, or any combination thereof. At block 254 of the process 250, the intervention system 40 may determine if the electric property data exceeds a threshold. The threshold may be based on a difference between the valve position and the set point. Additionally and/or alternatively, the threshold may be based on historical data indicative of nominal flow conditions measured by the electrical property data. As such, the threshold may be based on predetermined values associated with safe operation of the intervention package 42 and the subsea tree 14. In some embodiments, the threshold may not be met and the intervention system 40 may return to block 252 of the process. As such, the intervention system 40 may continually receive electrical property data from the electrical actuators 110.

In some embodiments, the intervention system 40 may determine that the electrical property data may exceed the threshold and proceed to block 256. At block 256 of the process 250, the intervention system 40 may control the electrical actuators 110 to stop flow of fluids. As such, fluid flow between the riser 46 and the intervention package 42 may be stopped. The electric valves 72 may be closed through electric actuation. At block 258 of the process 250, the intervention system 40 may initiate an emergency disconnect. Emergency disconnect may be initiated based on an unplanned change in the electrical property data. For example, the electric property data may indicate a sudden change in pressure, temperature, flowrate, or a combination thereof. Changes in pressure, temperature, flowrate, and/or additional properties may be indicative of operating conditions of the vessel 44, the subsea tree 14, the intervention package 42, or a combination thereof. In this manner, the electrical property data may be used to disconnect the intervention package 42 in a safe manner. As such, at block 260 of the process 250, the intervention system 40 may disconnect the riser 46 from the intervention package 42. In this manner, the riser 46 may be disconnected via a disconnect 50 (e.g., emergency disconnect). As such, the riser 46 may become uncoupled from the intervention package 42, disconnecting the vessel 44 from the intervention package 42.

At block 262 of the process 250, the intervention system 40 may analyze a status of the intervention package 42 and provide feedback data to the controller 60. The status of the intervention package 42 may be based on a pressure within fluid paths of the intervention package 42, temperature of fluids within the intervention package 42, calibration points based on standard operating signals from the intervention package, and the like. For example, the status of the intervention package 42 may be analyzed by evaluating sensor feedback data provided by pressure gauges, pressure transmitters, flow meters, temperature sensors, fluid composition sensors, and the like. The controller 60 of the intervention package 42 may provide data indicative of the status of the intervention package 42 to operators at the surface 100 to determine subsequent intervention processes.

Figure 9:
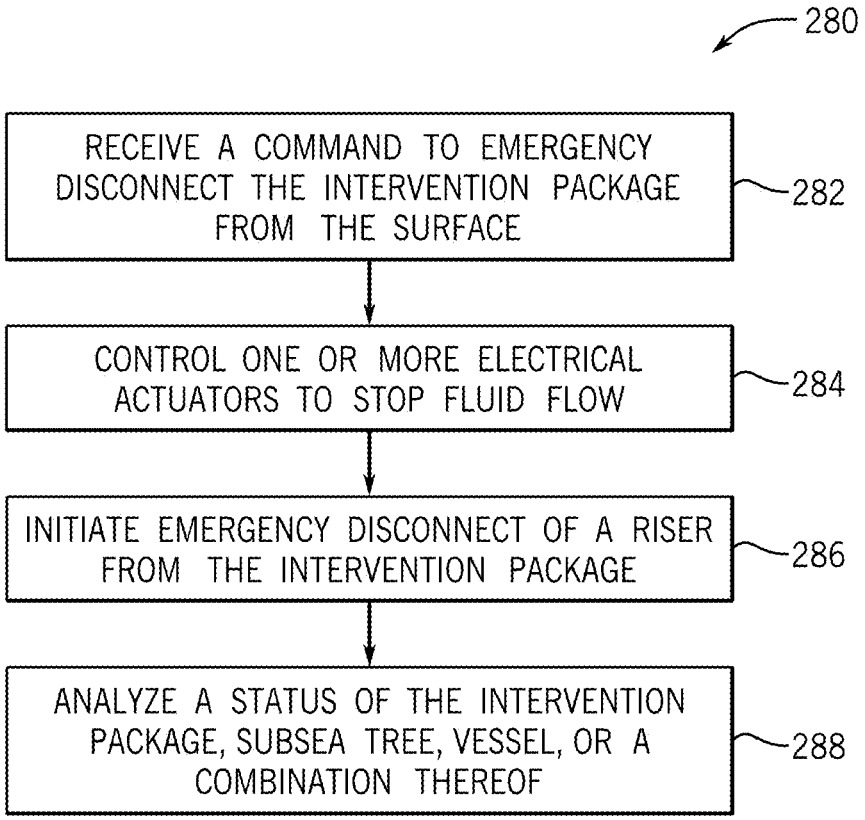
FIG. 9 is a flow chart of a process for performing an emergency disconnect of an intervention system, in accordance with an embodiment of the present disclosure.

FIG. 9 is a flow chart of a process 280 for performing an emergency disconnect of an intervention system 40. The process 280 may be performed by a computing device or controller disclosed above with reference to FIG. 2 and FIG. 6 or any other suitable computing device(s) or controller(s). Furthermore, the blocks of the process 280 may be performed in the order disclosed herein or in any suitable order. For example, certain blocks of the process 280 may be performed concurrently. In addition, in certain embodiments, at least one of the blocks of the process 280 may be omitted.

At block 282 of the process 280, the intervention system 40 may receive a command to emergency disconnect the intervention package 42 from the surface 100. The command may be based on signals provided by the electric valves 72, the electrical actuators 110, the sensors 70, one or more inputs from operators, signals from the subsea tree 14, or a combination thereof. At block 284 of the process 280, the intervention system 40 may control one or more electrical actuators 110 (e.g., including the electric valves 72) to stop fluid flow between the riser 46 and the subsea tree 14 via the intervention package 42. Once fluid flow between the riser 46 and the intervention package 42 is stopped, by actuating the electric valves 72 to a closed position, emergency disconnect of the riser 46 may be initiated. As such, at block 286 of the process 280, the intervention system 40 may initiate emergency disconnect of the riser 46 from the intervention package 42. The emergency disconnect may be initiated to protect the subsea tree 14 and/or the intervention package 42 from undue stress. For example, the vessel 44 may make an unanticipated change in course due to one or more external factors. As the riser 46 is tethered to the vessel 44, movement of the vessel 44 may impact the location of the riser 46. As such, emergency disconnect of the riser 46 from the intervention package 42 may protect the intervention package 42 from damage and allow the riser 46 to float freely in the subsea environment. In certain embodiments, the disconnect is controlled by the controller 60 of the intervention package 42, the ROV controller 86, a controller of the vessel 44, or a combination thereof. For example, the controller 60 may be configured to provide self-protection of the intervention package 42 by controlling the electric valves 72 and the disconnect 50, thereby closing fluid flow and separating from the riser 46 to protect against any damage.

At block 288 of the process 280, the intervention system 40 may analyze a status of the intervention package 42, the subsea tree 14, the vessel 44, or a combination thereof. The status may be indicative of one or more intervention processes, a maintenance status of components of the intervention system 40, and the like. The status of the intervention package 42 may provide insight if the riser 46 may be directly reconnected to the intervention package 42 and/or if the intervention package 42 may necessitate maintenance by the ROV 52 before reconnection.

Technical effects of the disclosed embodiments include an intervention system 40 for electrically operating and controlling electric valves 72 within an intervention package 42. In certain embodiments, the intervention package 42 may be used to provide control between a subsea tree 14 and a riser 46 providing fluids, such that fluid flow between the riser 46 and the subsea tree 14 is monitored and controlled to provide fluids to improve operation of the subsea tree 14. Advantageously, by electrically controlling actuation of the electric valves 72, the intervention package 42 may be controlled to provide fluids to the subsea tree 14 in a manner that is precisely controlled and monitored. For example, the intervention package 42 may undergo emergency disconnect from the riser 46 and/or the subsea tree 14. Emergency disconnect may be performed through electric actuation of the electric valves 72 quickly (e.g., in real-time) in response to changes or demands in electrical property data of the intervention package 42, thereby helping to improve operations of the intervention system 40. A controller 60 of the intervention system 40 may receive sensor feedback from one or more sensors 70 and analyze one or more parameters (e.g., valve set points, valve positions, temperature, pressure, flow rate, etc.) to determine procedures to improve safe operation of the intervention system 40. The disclosed techniques may result in automatic control of intervention packages 42 via electrical actuation with improved control in granularity of fluid flow based on direct control of electric valve actuation by the controller. Additionally and/or alternatively, the disclosed techniques may improve a flowrate of fluids entering and/or exiting the subsea tree 14 from the intervention package 42. Further, the intervention package 42 may be lighter as the electric valves 72 may be controlled via one or more batteries 186 without accumulation systems typical in hydraulic systems. As such, deployment of the presently disclosed techniques may provide improved efficiency and performance of intervention processes through electrical valve actuation.

The subject matter described in detail above may be defined by one or more clauses, as set forth below.

In certain embodiments, a system is provided that includes an intervention system used to couple to a subsea tree, wherein the intervention package includes a first interface configured to couple to the subsea tree, a fluid flow path through the intervention package to the first interface, a first electric actuator coupled to a first valve along the fluid flow path, and a controller coupled to the first electric actuator, wherein the controller is used to control the first electric actuator to control the first valve.

The system of the preceding claim, wherein the intervention package comprises a second interface configured to couple to a riser, and the fluid flow path extends between the first and second interfaces.

The system of the preceding claim, comprising a first disconnect between the intervention package and the subsea tree, a second disconnect between the intervention package and the riser, or a combination thereof, wherein the controller is configured to control the first or second disconnect.

The system of the preceding claim, wherein the controller is configured to analyze a status of the intervention package, the subsea tree, the riser, a vessel coupled to the riser, or a combination thereof, to identify an emergency condition to initiate the first or second disconnect.

The system of any of the preceding claims, wherein the intervention package comprises a second electric actuator coupled to a second valve along the fluid flow path, the controller is coupled to the second electric actuator, and the controller is configured to control the second electric actuator to control the second valve.

The system of the preceding claim, comprising at least one test passage having a pressure sensor and a valve configured to test for leakage of the first valve, the second valve, or a combination thereof.

The system of any of the preceding claims, comprising at least one energy storage coupled to the first electric actuator, the second electric actuator, or a combination thereof.

The system of any of the preceding claims, comprising at least one electric generator coupled to the at least one energy storage.

The system of any of the preceding claims, wherein the intervention package comprises a remote operating vehicle (ROV) interface.

The system of any of the preceding claims, wherein the controller is configured to monitor sensor feedback from the at least one sensor and adjust the first electric actuator in real-time to control a flow rate through the intervention package.

The system of any of the preceding claims, wherein the controller is configured to determine if a parameter of the first electric actuator exceeds a threshold.

The system of the preceding claim, wherein the threshold is based on comparison between a set point of the first valve and a valve position of the first valve.

In certain embodiments, a method includes obtaining sensor feedback from at least one sensor coupled to a fluid flow path through an intervention package having a first interface coupled to a subsea tree and controlling a first electric actuator coupled to a first valve along the fluid flow path at least partially based on the sensor feedback.

The method of the preceding claim, including controlling a second electric actuator coupled to a second valve along the fluid flow path at least partially based on the sensor feedback.

The method of the preceding claim, including identifying an emergency condition, closing the first valve via the first electric actuator, closing the second valve via the second electric actuator, and initiating a first disconnect between the intervention package and the subsea tree, a second disconnect between the intervention package and a riser, or a combination thereof, in response to the emergency condition.

The method of any of the preceding claims, including receiving electrical property data from the first electric actuator, determining if the electrical property data exceeds a threshold, and controlling the first electric actuator to close the first valve based on the electrical property data exceeding the threshold.

In certain embodiments, a system includes an intervention system to supply a fluid from a riser coupled to a vessel to a subsea tree, wherein the intervention system includes an intervention package with a first electric actuator coupled to a first valve and a second electric actuator coupled to a second valve. The system also includes a controller having a processor, a memory, and instructions stored on the memory and executable by the processor to receive one or more signals from one or more sensors, and control, via the first electric actuator and the second electric actuator, a fluid flow between the intervention package and the subsea tree.

The system of the preceding claim, wherein the controller is configured to coordinate control of the first and second electric actuators coupled to the respective first and second valves with control of one or more valves of the subsea tree.

The system of any of the preceding claims, wherein the controller is configured to initiate an emergency disconnect, control the first and second electric actuators to close the respective first and second valves, and disconnect the riser from the intervention package.

The foregoing description, for purpose of explanation, has been described with reference to specific embodiments. However, the illustrative discussions above are not intended to be exhaustive or to limit the disclosure to the precise forms disclosed. Many modifications and variations are possible in view of the above teachings. Moreover, the order in which the elements of the methods described herein are illustrated and described may be re-arranged, and/or two or more elements may occur simultaneously. The embodiments were chosen and described in order to best explain the principles of the disclosure and its practical applications, to thereby enable others skilled in the art to best utilize the disclosure and various embodiments with various modifications as are suited to the particular use contemplated.

Finally, the techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ," it is intended that such elements are to be interpreted under 35 U.S.C. § 112(f). However, for any claims containing elements designated in any other manner, it is intended that such elements are not to be interpreted under 35 U.S.C. § 112(f).

The invention claimed is:

1. A system, comprising:

an intervention package configured to couple to a subsea tree, wherein the intervention package comprises:

a housing;

a first interface disposed on a first side of the housing, the first interface configured to removably couple to the subsea tree;

a second interface disposed on a second side of the housing, the second interface configured to removably couple to a riser;

a fluid flow path extending through the intervention package from the first interface to the second interface;

a first electric actuator coupled to a first valve along the fluid flow path;

a second electric actuator coupled to a second valve along the fluid flow path;

a pressure test flow path including an inlet and an outlet, the inlet fluidly disposed between the first valve and the second valve such that the inlet of the pressure test flow path is coupled to an outlet of the first valve and an inlet of the second valve, the outlet of the pressure test flow path extending through the housing to a pressure test port, and the pressure test port configured to receive fluid from an external source; and a controller coupled to the first electric actuator, wherein the controller is configured to control the first electric actuator to control the first valve.

2. The system of claim 1, comprising a first disconnect between the intervention package and the subsea tree, a second disconnect between the intervention package and the riser, or a combination thereof, wherein the controller is configured to control the first or second disconnect.

3. The system of claim 2, wherein the controller is configured to analyze a status of the intervention package, the subsea tree, the riser, a vessel coupled to the riser, or a combination thereof, to identify an emergency condition to initiate the first or second disconnect.

4. The system of claim 1, wherein the controller is coupled to the second electric actuator, and the controller is configured to control the second electric actuator to control the second valve.

5. The system of claim 4, wherein the pressure test flow path comprises a pressure sensor and a valve configured to test for leakage of the first valve, the second valve, or a combination thereof.

6. The system of claim 4, comprising at least one energy storage coupled to the first electric actuator, the second electric actuator, or a combination thereof.

7. The system of claim 6, comprising at least one electric generator coupled to the at least one energy storage.

8. The system of claim 1, wherein the intervention package comprises a remote operating vehicle (ROV) interface.

9. The system of claim 1, wherein the controller is configured to control the first electric actuator to control the first valve in coordination with one or more valves of the subsea tree.

10. The system of claim 1, wherein the intervention package comprises at least one sensor coupled to the fluid flow path and wherein the controller is configured to monitor sensor feedback from the at least one sensor.

11. The system of claim 10, wherein the controller is configured to control the first electric actuator to control the first valve, a flow rate through the intervention package, or a combination thereof, at least partially based on the sensor feedback from the at least one sensor.

12. The system of claim 11, wherein the controller is configured to determine if a parameter of the first electric actuator exceeds a threshold and wherein the threshold is based on comparison between a set point of the first valve and a valve position of the first valve.

13. A method, comprising:

obtaining sensor feedback from at least one sensor coupled to a fluid flow path through an intervention package, the intervention package comprising:

a housing;

a first interface disposed on a first side of the housing, the first interface configured to removably couple to a subsea tree;

a second interface disposed on a second side of the housing, the second interface configured to removably couple to a riser;

the fluid flow path, wherein the fluid flow path extends through the intervention package from the first interface to the second interface;

a first electric actuator coupled to a first valve along the fluid flow path;

a second electric actuator coupled to a second valve along the fluid flow path; and a pressure test flow path including an inlet and an outlet, the inlet fluidly disposed between the first valve and the second valve such that the inlet of the pressure test flow path is coupled to an outlet of the first valve and an inlet of the second valve, the outlet of the pressure test flow path extending through the housing to a pressure test port, and the pressure test port configured to receive fluid from an external source; and controlling the first electric actuator coupled to the first valve along the fluid flow path at least partially based on the sensor feedback.

14. The method of claim 13, comprising controlling the second electric actuator coupled to the second valve along the fluid flow path at least partially based on the sensor feedback.

15. The method of claim 14, comprising:

identifying an emergency condition;

closing the first valve via the first electric actuator;

closing the second valve via the second electric actuator; and initiating a first disconnect between the intervention package and the subsea tree, a second disconnect between the intervention package and the riser, or a combination thereof, in response to the emergency condition.

16. The method of claim 13, comprising:

receiving electrical property data from the first electric actuator;

determining if the electrical property data exceeds a threshold; and controlling the first electric actuator to close the first valve based on the electrical property data exceeding the threshold.

17. A system, comprising:

an intervention system configured to supply a fluid from a riser coupled to a vessel to a subsea tree, wherein the intervention system comprises an intervention package, the intervention package comprising:

a housing;

a first interface disposed on a first side of the housing, the first interface configured to removably couple to the subsea tree;

a second interface disposed on a second side of the housing, the second interface configured to removably couple to the riser;

a fluid flow path, wherein the fluid flow path extends through the intervention package from the first interface to the second interface;

a first electric actuator coupled to a first valve, the first valve disposed along the fluid flow path;

a second electric actuator coupled to a second valve, the second valve disposed along the fluid flow path; and a pressure test flow path including an inlet and an outlet, the inlet fluidly disposed between the first valve and the second valve such that the inlet of the pressure test flow path is coupled to an outlet of the first valve and an inlet of the second valve, the outlet of the pressure test flow path extending through the housing to a pressure test port, and the pressure test port configured to receive fluid from an external source; and a controller having a processor, a memory, and instructions stored on the memory and executable by the processor to:

receive one or more signals from one or more sensors; and control, via the first electric actuator and the second electric actuator, a fluid flow between the intervention package and the subsea tree.

18. The system of claim 17, wherein the controller is configured to coordinate control of the first and second electric actuators coupled to the respective first and second valves with control of one or more valves of the subsea tree.

19. The system of claim 17, wherein the controller is configured to:

initiate an emergency disconnect;

control the first and second electric actuators to close the respective first and second valves; and disconnect the riser from the intervention package.

* * * * *